493-255 SP
FIP8608 XR 4,546,592

United States Patent [19]

Reil

[11] Patent Number: 4,546,592

[45] Date of Patent: Oct. 15, 1985

[54] APPARATUS FOR SEALING A LIQUID PACK

[75] Inventor: Wilhelm Reil, Bensheim, Fed. Rep. of Germany

[73] Assignee: Tetra Pak Developement S.A., Pully, Switzerland

[21] Appl. No.: 463,722

[22] Filed: Feb. 4, 1983

[30] Foreign Application Priority Data

Feb. 11, 1982 [DE] Fed. Rep. of Germany ..... 324773

[51] Int. Cl.[4] ..... B65B 51/14; B65B 7/06

[52] U.S. Cl. ..... 53/373; 53/384; 493/255; 493/206

[58] Field of Search ..... 53/373, 384; 493/255, 493/259, 206, 209

[56] References Cited

U.S. PATENT DOCUMENTS

| | | | |
|---|---|---|---|
| 2,011,198 | 8/1935 | Morey | 53/373 |
| 2,415,978 | 2/1947 | Vergobbi | 53/373 |
| 2,952,959 | 9/1960 | Piazze | 53/373 |
| 2,996,855 | 8/1961 | Bergeron et al. | 53/373 |
| 3,220,161 | 11/1965 | Lohse et al. | 53/373 |
| 3,766,710 | 10/1973 | Goodwin et al. | 53/373 |

FOREIGN PATENT DOCUMENTS

| | | | |
|---|---|---|---|
| 1187177 | 2/1965 | Fed. Rep. of Germany | 53/373 |

*Primary Examiner*—Daniel C. Crane
*Attorney, Agent, or Firm*—Finnegan, Henderson, Farabow, Garrett & Dunner

[57] ABSTRACT

Apparatus for sealing a liquid package made of paper coated with plastic on at least one surface including a pair of extending fingers that can be inserted in the open end of the package to flatten the top edges thereof into a single strip; a pair of welding jaws to seal the top folded seam strip; and drive mechanisms to operate the fingers and jaws. Each extending finger is flat at its engaging end with the package, the narrow edges of which are rounded in cross section, with its longitudinal axis initially perpendicular to the top of the folded seam strip. The fingers are driven down and out to flatten the top edges and form an elongated seam strip whereafter the welding jaws, driven synchronously with the movement of the fingers, seal and strip the seam strip off the extending fingers.

10 Claims, 10 Drawing Figures

APPARATUS FOR SEALING A LIQUID PACK

Figure 1:
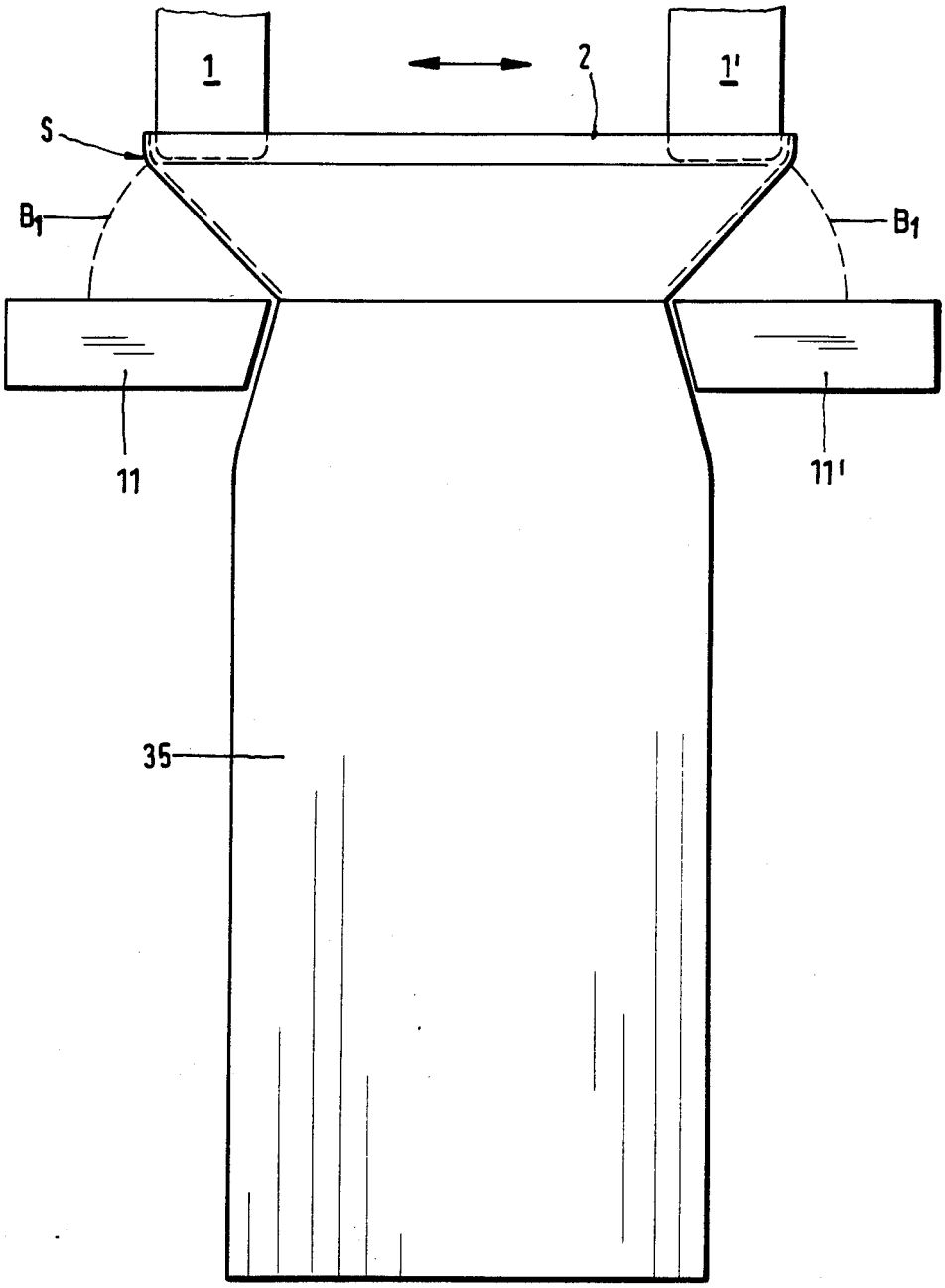

The invention relates to an apparatus for sealing a pack filled with fluid, wherein the supporting material consists of paper, cardboard or the like and is coated with plastics on at least one surface, comprising a pair of extending fingers for flattening the top edge of the pack with the folded seam strip, the fingers being insertable in the open end of the pack and driven for an extending movement; a pair of welding jaws, fixed to pivoted levers, or sealing the top folded seam strip; and a drive provided with guiding surfaces.

An apparatus of this type is known from DE-PS No. 1 187 177. Here both the welding jaws and the extending fingers are located on a common carrier which can be raised or lowered; they are mounted on it and driven by its intermediary. It is consequently a disadvantage that the drive mechanism is complex and delicate. More seriously, however, accurate sealing cannot be obtained with correct folding of the pack, because the extending fingers become caught up in the aperture left in the top folded seam strip during the sealing process. When the pack, then sealed, is removed from the machine, two non-sealed, open places within the top folded seam strip are left at the extremities of the pack end in question. An extra welding process is therefore necessary to seal these openings.

A further disadvantage is that the extending fingers only make a pivoting movement, in which the free lower ends pass through a larger pivoting arc than those parts of the bar-shaped fingers which are nearer the centre of rotation. Since the extending process begins in the oblique position of the fingers, these necessarily fail to engage the top seam strip at the open end of the pack at the correct place, namely exactly where the two obliquely converging creases meet to form the triangular flap of the block-shaped end; instead the fingers disadvantageously engage the outside edge of the top folded seam strip thereover, with the result that correct folding is not obtained because the tensile and folding forces initiated by the fingers for folding purposes are not directed along the creases and particularly now along those necessary to form the triangular flap.

As a result of the turning action the pack may be damaged from the inside right at the above-mentioned tip of the triangular flap where the two flap-forming creases meet. The pack may then leak even when the seam to seal the open side of the pack is correctly closed.

Another disadvantage is that only low pressures can be generated between the welding jaws, which are moved at right angles to the movement of the fingers. A long welding time is consequently required.

The invention therefore aims to improve the apparatus with the above-mentioned features, so that a filled pack can be folded exactly along the creases provided and at the same time imperviously sealed in one operation, so to speak in one cycle.

According to the invention this aim is achieved, in that each extending finger is constructed in strip form at its engaging end, with narrow edges which are rounded in cross section, that its longitudinal axis is perpendicular to the top folded seam strip, at least during its movement in the region of the initial position, and is driven by means of a cam, for movement in a plane located above the seam strip, and that each welding jaw is driven synchronously with the movement of the extending fingers, for rotation about a shaft arranged parallel with the top seam strip and held in a stationary bearing, in such a way that the jaw strips the seam strip off the extending fingers in their end position.

The above-mentioned measures enable the open, creased end of the pack to be folded exactly in a very short cycle, with subsequent complete welding of the entire sealing seam, particularly in a state with the two triangular flaps extended in one plane. The pack may e.g. be round or square in cross section. It should be thought of as being closed at one side and put into the apparatus according to the invention in the filled state, so that e.g.—with the pack generally standing—the subsequent end wall is "below" while the base, which is pre-creased but open, is at the opposite side, i.e. uppermost in the apparatus. A block type base is preferably folded and sealed as described, with the sealing seam in the top folded seam strip running from one end to the other and closing the filled pack absolutely imperviously after the working cycle in question. For this purpose the length of the sealing jaws is greater than that of the top folded seam strip. It will be appreciated that, with this extended seam strip in the region of the block type base, the two triangular flaps lie in a common plane and are extended outwards.

The measures according to the invention give a short welding time, so that working cycles of the order of 1.5 seconds or less are obtained. A short welding time means high pressure, for time, heat and pressure are the three parameters which ultimately interact to produce the weld. Despite the short welding time, which might even be shorter than the total working cycle, an absolutely impervious weld is obtained with the invention, running from one end of the top folded seam strip to the other and across both edges at the ends of the strip. The measures according to the invention produce this impervious welding, although exact folding is being carried out simultaneously, with the open top pack of oval or square cross section passing from a so-called crude shape to the finished folded seam strip in the manner described above.

In accordance with the invention it is advantageous for each welding jaw to be fixed to two pivoted levers, the length of the levers being such that the shaft and associated jaw are provided on opposite sides of a plane extending through both fingers. To gain a clearer idea of the processes carried out by the apparatus according to the invention, one should think of the plane extending through the two fingers; when the pack is inserted in its final state, i.e. with the folded seam strip welded, that plane is above the strip. At least the engaging ends of the fingers move only in that plane, as will be explained in greater detail later. The pivoted levers make it possible for the jaws so to speak to be guided round the extending station, in such a way that the extending action, i.e. the movement of the extending fingers, does not prevent welding, i.e. the movement of the welding jaws. In addition the long pivoted levers can apply high pressures to the welding jaws. Shortly before they engage the outside of the top folded seam strip, the jaws may advantageously move along paths such that they strip the end of the pack and particularly the seam strip off the fingers, when the fingers are stationary and have in fact reached their final position. The upper end of the pack is simultaneously put into the desired final shape, for each welding jaw presses onto the top surface of the block-type end already put together by the fingers. In a special machine the top folded seam strip is pulled approximately 8 to 9 mm downwards out of engagement with the fingers. As a result the top seam strip, which is a double strip of cardboard, is completely free from action by any machine components from one edge to the other, i.e. from beginning to end, so that the sealing jaws can carry out their function, advantageously at high pressure, immediately afterwards.

It has already been mentioned in connection with prior art how critical the point at the tip of the triangular flap is. The fact that the extending finger is constructed like a bead or like a strip with a horizontal edge at the bottom and is guided perpendicularly enables the finger to be applied to the exact tips of the triangular flaps from inside the ends of the seam strip. It also enables the stretched-out position of the seam strip, described above, to be obtained by moving the fingers out away from each other, without any further relative movement between the tip, with the adjoining edge on the strip, and the engaging end of the extending finger. It is further advantageous for this movement of the extending fingers to take place within the movement bringing the tip of the triangular flap from the above-mentioned crude shape prior to folding to the fully folded position of the seam strip. The invention thus provides a closed curve of this movement of the fingers, and the fingers do actually follow the tip of the triangular flap as it moves downwards along an appropriate path. This avoids excessive tension caused e.g. by one finger moving away from the other too quickly. It also ensures that the inner edge at the tip of the triangular flap wil not be damaged. The importance of this place is mentioned above. The measures according to the invention thus produce a pack which is undamaged and sealed completely imperviously.

In a preferred block-type end according to the invention the sealing seam within the top folded seam strip is 2 mm wide, and the seam is some distance away from the lower edge of the seam strip, so that the critical place, i.e. the corner at the tip of the triangular flap, would provide a connection between the interior of the pack and the atmosphere in the event of damage. The fact that the lower edge of the finger extends horizontally and is rounded but narrow like a blunt knife enables engagement between the appropriate external corner of the finger and the tip of the triangular flap to be ensured and to be maintained during the extending movement and all folding movements. It is desirable for the fingers e.g. not to be turned but instead to be guided in a plane by a suitable cam.

In an advantageous further embodiment of the invention a cam for driving each extending finger is in the form of a cam member provided in a stationary plate, with a cam roller guided movably on the cam member and joined to the finger, the cam roller being driven for displacement parallel with the fingers by means of a drive. This is a simple way of enabling the fingers to be moved in the desired manner, with vertical and horizontal components, in a desired plane, namely that extending above the seam strip.

In this case it is desirable, in accordance with the invention, for the cam roller to be mounted on a shaft extending transversely through two roller-carrying plates, the roller-carrying plates being fixed to a slide which is freely movable longitudinally on a mandrel, and for the mandrel to be fixed to a guide displaceably mounted on a stationary column. Thus the guide needs only to be moved e.g. vertically upwards or downwards (naturally within predetermined mechanical limits) and the slide can thereby be moved in a horizontal direction, although the slide also moves vertically on its mandrel. Thus complex paths can be travelled using simple means.

In a preferred embodiment of the invention the cam member is in the form of a curved slot, and the cam roller is guided in the slot. In this embodiment the longitudinal axis, which can be thought of as passing centrally through the finger in question in a vertical direction, may run substantially perpendicular to a line extending longitudinally in the top seam strips. With this construction, with the cam rollers running in the slots, the fingers thus move not only in the plane which can be thought of as being vertically above the top seam strips; at every movement the longitudinal axes of the fingers are substantially normal to the above-mentioned line or normal to the top seam strip. In the drawings what we are concerned with is a plane located in the plane of the paper, in which these longitudinal axes are then also located.

In this last mentioned embodiment of the invention each finger is angular in cross section with a base portion, the driving and fixing end of which is arranged outside the extending and welding station. With fingers of this type in a machine of normal construction each base portion will be in a horizontal plane and the fingers will lie in a vertical plane as described above. The base portion may be fixed to a drive outside the extending and welding stations, so as to realise the possibility of doubling the action of the drive or, in other words, the possibility of operating welding and folding stations in both directions with one central drive.

In a different embodiment of the invention it is advantageous for a pivoting shaft to be arranged on a girder and to have two pivoted levers rotatable about it, each lever joined to a cam roller, the fingers being attached to the free ends of the levers. In this differently constructed embodiment of the invention the fingers do again carry out a straight sliding movement from the initial position to engagement with the top seam strips, with the above-mentioned longitudinal axis in the fingers lying normal to the line in the top seam strip. After engagement in the seam strip, however, a pivoting of the fingers is carried out, namely about the shaft held rotatably by the girder. This measure reduces the demands put on the drive of the machine.

If, with an appropriate further feature of this embodiment, the deflection of the pivoted lever is less than 30° and preferably only about 20° from the vertical, this eliminates the disadvantages described at the beginning in connection with prior art. It is true that in this embodiment a circular or swivelling movement is again carried out as a result of the pivoting, but the pivoted levers are very long in the part in question, namely from the free lower end of the fingers up to the pivoting shaft. With 1-liter milk packs, for example, this length is more than the height of the pack. Hence the finger in question is moved only very slightly from its vertical position into the deflected or swivelled position. The drive on the other hand is directed only to a rotating movement because of the cam control, and this obviously simplifies the construction of the drive.

In accordance with the invention it is advantageous if the pivoting shaft girder is forked to hold a double station and, by means of the pivoting shaft, has two pivoted levers on each side, preferably interconnected by a tension spring. The pivoting shaft carrier may e.g. by supported by a stationary column at one side and fixed so that it can move straight, whereas at the opposite end it may be provided with two supports owing to the fork, with the two pivoted levers for the two fingers provided on the supports. The fork thus enables two pairs of pivoted levers to be provided, with the two pairs of fingers. Each pair of fingers may then be joined by a roller-carrying shaft with a cam roller seated on it. Since two fingers are always necessary to spread out the seam strip, two roller-carrying shafts are provided, each with two fingers at the ends. A cam roller is provided in each case, preferably in the centre of these roller-carrying shafts, and these run on opposite sides of the cam member so that the fingers are deflected along the desired path of movement. The curve on the cam member is shaped so that the path of movement of the particlar outer corner of the finger follows the critical point at the end of the top seam strip. Owing to the long swivel arm between the free end of the finger and the swivelling shaft or point of rotation an extension takes place such that the cam member is generally longer in a vertical direction than the vertical component of the path of movement of the corner in question.

In accordance with the invention it is advantageous if the shaft for driving the welding jaws is joined to a sleeve by a feather with clamping means, the sleeve engaging around the jaw and carrying the pivoted levers, if the feather and clamping means are arranged midway along the shaft and sleeve, and if the clamping means include a clamp-type reinforcement with a tension member to clamp together a slot in the sleeve. If, in an advantageous form of the invention, toggle levers are used for driving the welding jaws and moving the pivoted levers thereof, then in theory infinitely high pressures are obtained between the welding jaws, while the above-mentioned measures absorb excess pressures through torsional action between the shaft and the sleeve. Exact parallelism between the two interacting welding jaws may also be obtained by the above measures, because the feather and also the clamping means are arranged midway along the length of the shaft and sleeve. Many errors in parallelism are compensated for automatically by the torque rod arrangement or torsional action. In addition the torsional force can be calculated exactly and then stipulate a defined pressure between the welding jaws.

Another preferred embodiment of the invention provides that the shaft held in the bearing is joined to a first drive lever by a feather, polygonal connection or the like, and that the first drive lever is in turn connected with a resilient bias to a second drive lever, which is arranged with a non-positive connection by means of a two-lever joint. We are connected here with the drive for the welding jaws, i.e. a movement which has to be transmitted to the above-mentioned shaft. The non-positive connection is via a toggle lever or double-lever joint to a drive lever, the second drive lever mentioned above, and from there via the first drive lever and the feather connection to the shaft. A means for resiliently biasing the two drive levers is interpolated, preferably through a screw connection, for example if a packet of plate springs is fixed by a tie rod held with a nut and screw. By releasing the screw in question it is then possible to separate the first drive lever from the second in this embodiment. But since the first drive lever is in turn connected to the shaft and thus to the welding jaw with the electrical resistance wire, the sealing jaw, which is subject to wear, can be swung out around the said shaft without dismantling the double lever joint, so that it is readily accessible for maintenance work and preferably for exchange.

The arrangement of plate springs between the first and second drive lever further has a favourable effect on the balance of forces. The resilient biasing in fact ensures that, even with incorrect thicknesses, e.g. double thicknesses of paper adjacent single ones, the overloading of the welding jaws will be compensated for by the spring unit. Wear in the bearings, which might otherwise lead to disadvantageous fluctuations in pressure and thus to incorrect sealing work, can also be compensated for. The springs compensate for such wear or for the different thicknesses of paper.

It is further advantageous according to the invention for a lateral displacement rail to be provided on each side of the pack, which is inserted between stationary guide plates, substantially below the end position of the extending fingers. It will be appreciated that, for example, a pack which is filled with liquid and fed by a conveyor to the machine according to the invention with its open end uppermost, will bulge out in the central and upper portion, so that the filling level will drop sufficiently to ensure that packing will not take place without the inclusion of air. The displacement rail under the folding station enables the bulges in the pack to be pressed in far enough to raise the filling level and form an inward curve in the block-like end which has to be formed, since there is a certain low pressure in the pack after sealing. This further makes it possible for the triangular flaps to be folded satisfactorily onto the block-shaped end after sealing and sealed onto the outside thereof. The pack then advantageously has better stability under load.

The measures according to the invention thus enable the block-shaped end to be folded and welded in one very short working cycle, i.e. with a single movement which comprises two synchronised individual movements as explained above.

Figure 2:
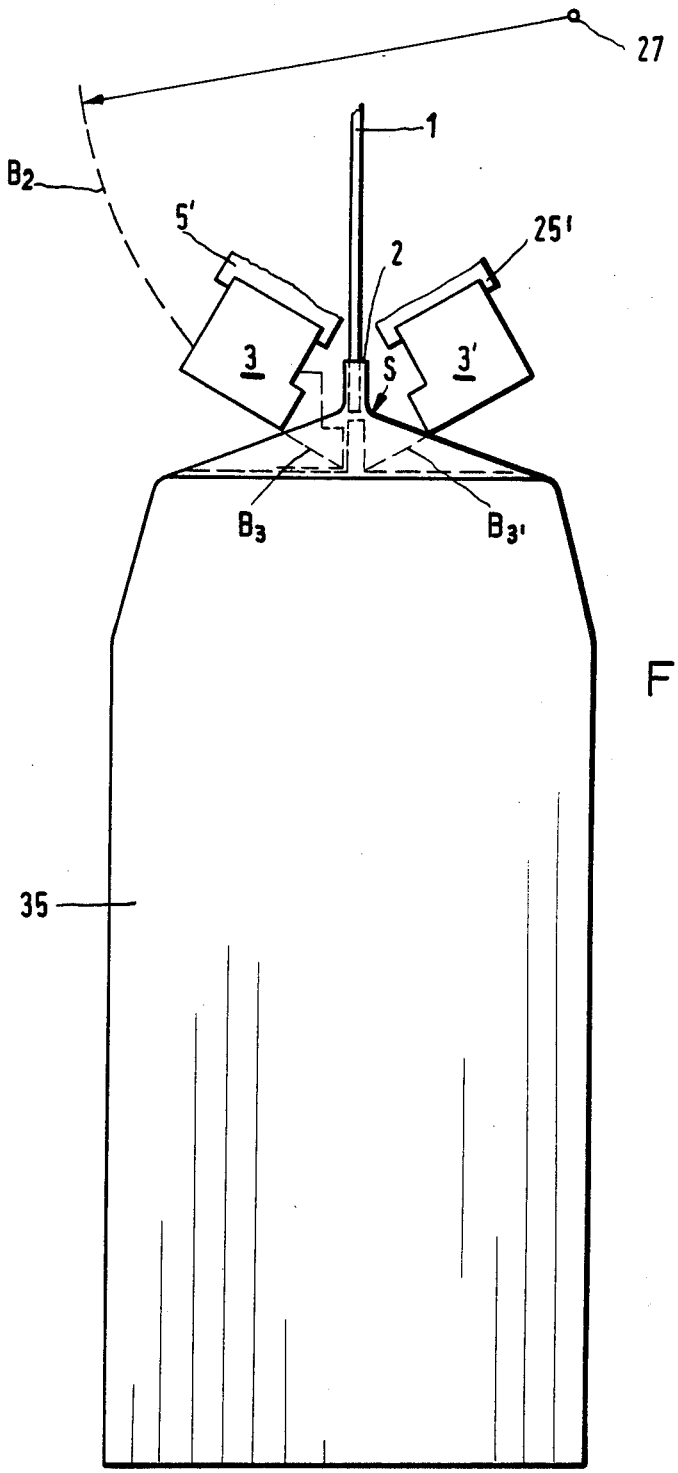
Figure 3:
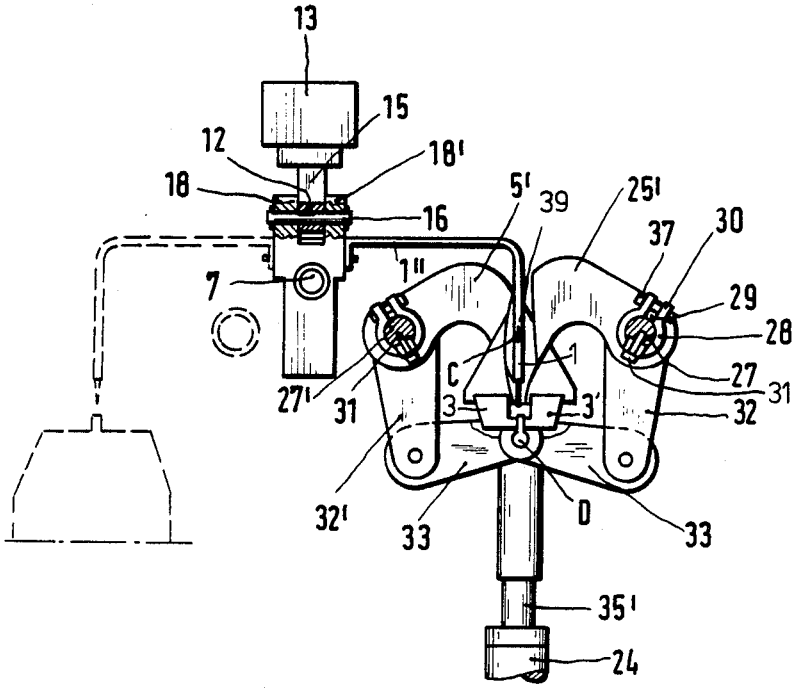
Figure 4:
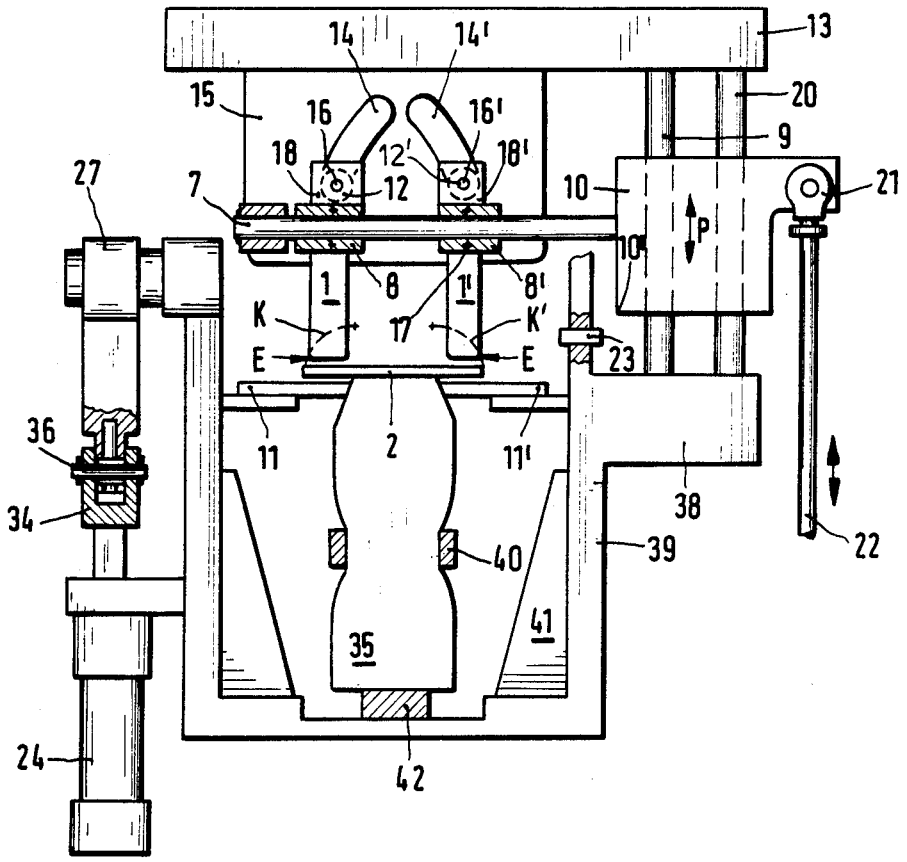
Figure 5:
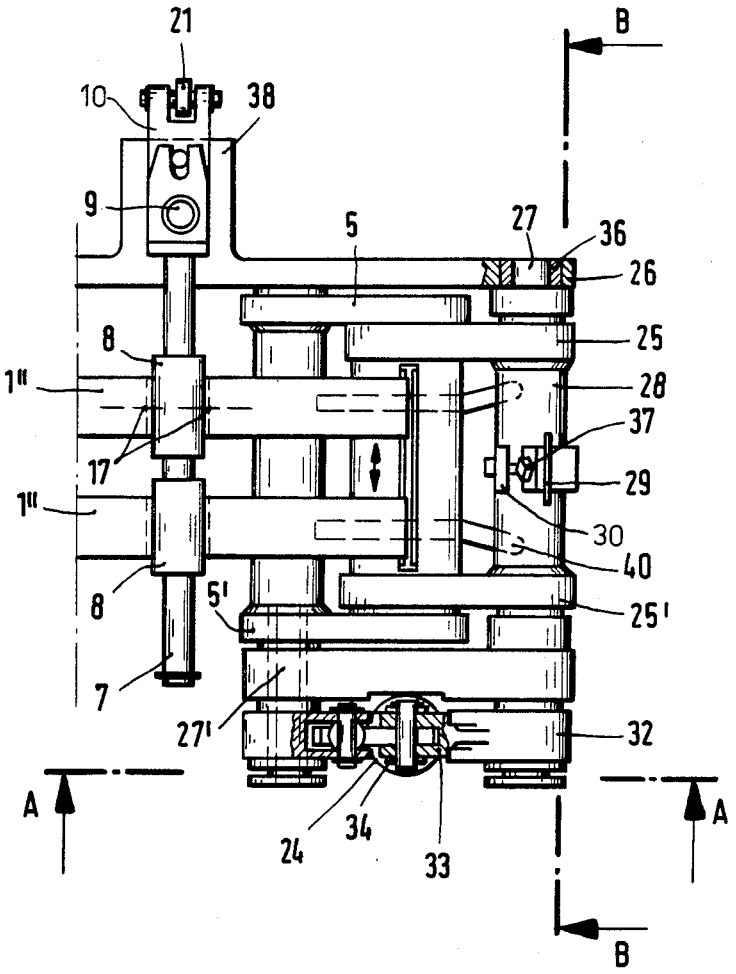
Figure 6:
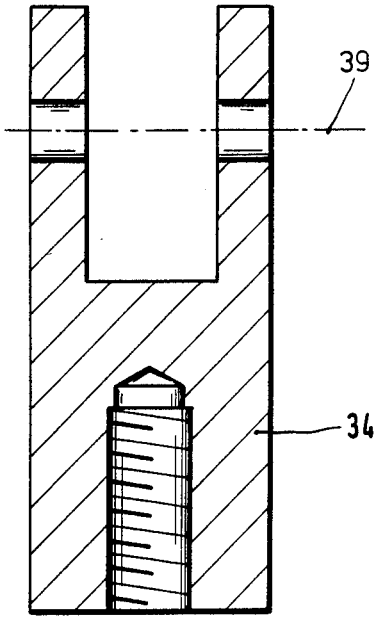
Figure 7:
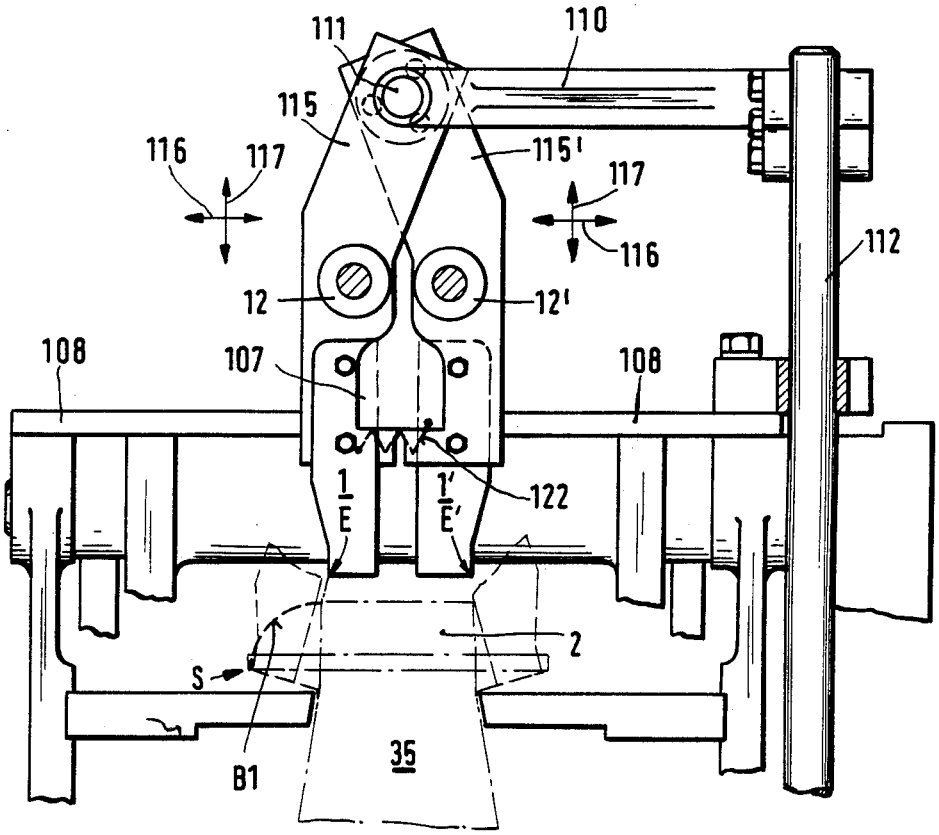
Figure 8:
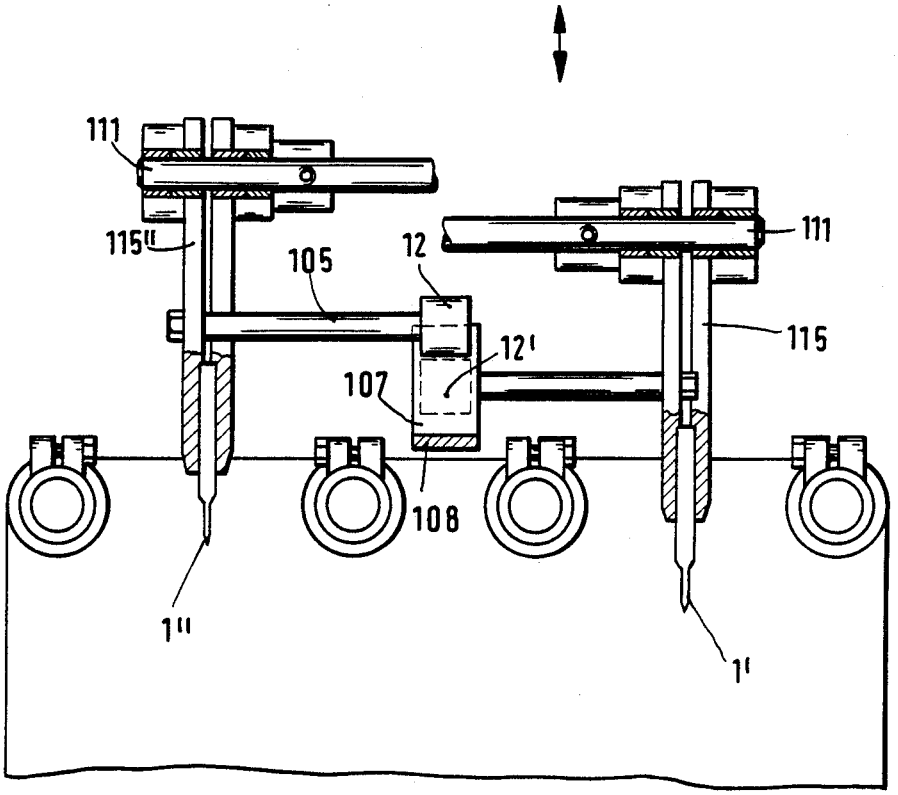
Figure 9:
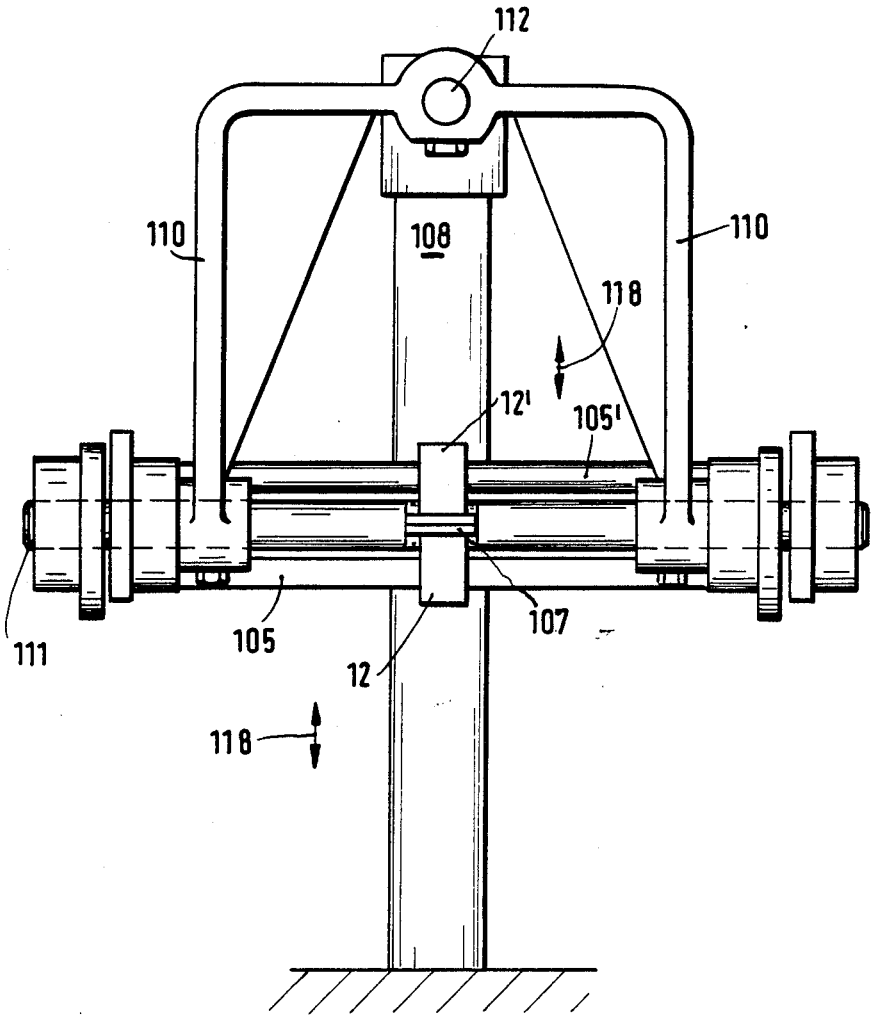
Figure 10:
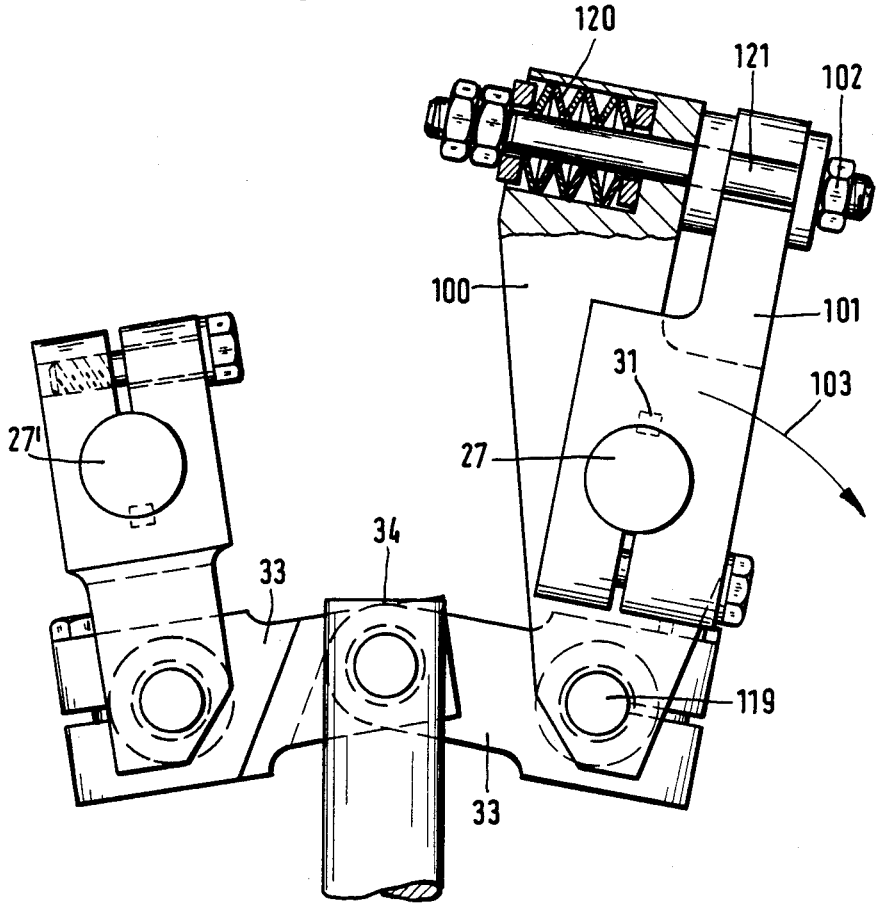

Further advantages, features and applications of the invention will emerge from the following description of two preferred examples, in conjunction with the accompanying drawings, in which:

FIG. 1 is a diagram showing the initial position of the extending fingers following their insertion into the upper folded seam strip of the pack arranged inside the stationary guide plates, FIG. 2 is a similar diagrammatic view of the apparatus, looking at it from left to right in FIG. 1, FIG. 3 is a somewhat more detailed representation, partly in section and partly broken away, of the apparatus with the welding jaws and bearings, corresponding to the line A—A in FIG. 5, FIG. 4 is a sectional view similar to FIG. 3 but taken along the line B—B in FIG. 5, FIG. 5 is a plan view of the apparatus shown in FIGS. 3 and 4, FIG. 6 shows the joint for driving the welding jaws, taken out and drawn separately, FIG. 7 is a view similar to FIG. 4 but showing a different embodiment with pivoted levers, the pivoting movement being transmitted via the cam rollers and controlled by the cam member, FIG. 8 is a front elevation of the FIG. 7 view, showing the double station, FIG. 9 is a plan view of the FIG. 8 view, given to clarify the forked construction of the pivoted shaft support, and FIG. 10 shows part of the lever and drive connection for the sealing jaws, similar to the right-hand part of FIG. 3 but with a different embodiment provided, to facilitate exchange of the sealing jaw provided with the electrical resistance wire.

In FIG. 1 the pack 35 is shown when it has been put into a rounded shape, without the displacement rails 40 which will be explained later, and inserted in stationary guide plates 11 and 11'. The pack which is here used as an illustration is sealed at the bottom at the subsequent "top end wall", which also has an opening device (not shown). At the "top" side opposite, the pack should be thought of as being open in the region of the top folded seam strip 2. In plan view the as yet unextended seam strip 2 would be circular, oval or egg-shaped, its shape being substantially predetermined by the two stationary guide plates 11 and 11'. By means of cams 14 and 14' which will be explained later, two spaced extending fingers 1 and 1' are driven straight into the upper seam strip 2 as far as the lower edge thereof. S refers to the critical point at the tip of the triangular flap. The vertical lower edge of each extending finger 1, 1' has an angle on the outside, corresponding to the critical angles S on the pack. This angle is slightly rounded and comes into contact with the pack from the inside, at the left hand and right hand folded edge, i.e. the beginning and end of the seam strip 2. Two curved paths B1 are shown in broken lines, passing through the respective outer angles of the extending fingers 1, 1' and the tips S of the pack while the upper seam strip is being stretched and laid on the stationary guide plates 11, 11'. In this movement the front and rear cardboard strip of the seam strip 2 should be thought of as moving into the plane of the drawing from a position respectively in front of or behind it.

FIG. 2 shows the state of the pack 35 in the end position in FIG. 1 (without 11, 11'), in the same view as FIG. 1 but looking at it from left to right.

The construction of the extending finger 1 in strip or bead form, with the rounded edges both in cross section and at the corners, is clearly visible. The horizontal bottom edge of the finger 1 can be seen at the bottom of the seam strip 2. The two welding jaws 3 and 3' can also be seen from FIG. 2, where they are shown diagrammatically and without any holding means. The path B2 indicates the path of movement during the swinging action about the shaft 27, which can be seen more clearly from FIGS. 3 and 5. As an explanation of the folding process and also the process of peeling the seam strip 2 off the lower engaging end of the fingers 1, 1', FIG. 2 finally also shows the two broken line curves B3, indicating the path taken by the bottom inner corners of the jaws 3, 3' leading to the welding operation.

In other words the apparatus according to the invention carries out the folding and sealing of the block base in the following manner. The pack is pre-shaped with a round or slightly square cross section at the top end. The open pack is inserted between the two stationary, spaced guide plates 11, 11', and the upper edge with the open folded seam strip 2 may stretch slightly in the process. The distance between the extending fingers 1, 1' is governed by a cam 14, 14' and is set so that, when the finers descend, the outer angles thereof come into the vicinity of the critical angles S of the triangular flaps. The FIG. 1 condition is now reached.

After this, although the extending fingers 1, 1' move apart, they simultaneously move downwards along the curves B1. The top seam strip 2 is stretched in the process and the two layers of cardboard are brought together. The fingers then finally reach an end position shown in FIG. 2. They stay in this position while the welding jaws 3 and 3', which in the meantime have been removed out of an initial position (not shown), are moved on out of the FIG. 2 position along the path B3. The broken line paths B2 and B3 for the respective welding jaws 3 and 3' will be seen to have a relatively large radius, with its centre at the shafts 27 and 27' shown in FIGS. 3 and 5. In the movement from the beginning to the end of the broken line curved path B3, the inner corners or edges of the welding jaws 3, 3' push the already pre-folded part of the top block-shaped end into the horizontal position shown in broken lines in FIG. 2. The seam strip 2 is then pulled down right off the fingers 1, 1' and is free from any tool, ready for welding. This is followed by the processes of bringing together the jaws 3, 3', sealing, opening and conveying away.

The exact conformation of a preferred embodiment of the invention can best be described with reference to FIGS. 3 to 6.

Both the welding station and the extending station are mounted on two vertical stationary columns 9 and 20 by means of a bracket 38 (FIG. 5). In the lower region a pillar 39 is shown in FIG. 4, with a reinforcing fin 41 and a stationary guide rail 42 extending horizontally at bottom centre. This forms the frame for the machine on the underside and on top opposite a carrier 13.

The extending station can be seen clearly from FIGS. 4 and 5. The thus stationary plate 15 is located on the beam 13. Two arcuate slots are provided in the plate 15 as cams 14, 14' and arranged as an opposing pair with the top ends inclined towards one another. The cam roller 12, 12', mounted on a shaft 16, 16' which in turn extends through two roller carrying plates 18, 18' (FIG. 3), can move in the cam 14, 14'. The roller carrying plates are not stationary and move together with the shaft 16 and cam roller 12 (and 16' and 12' respectively).

Base members 1'' (FIG. 5) and thus the extending fingers 1, 1' are fixed to the roller carrying plates 18, 18' by screws 17. According to the movement of the cam rollers 12, 12' the fingers 1, 1' and particularly their outer corners E, E' also move (FIG. 4); with the cams 14, 14' shown in FIG. 4 they move along the curves K, K' illustrated.

FIG. 4 shows the actual state where the upper seam strip 2 is stripped off the fingers 1, 1' in their end position and lies on the stationary guide plate 11 or 11'.

Horizontally movable slides 8, which can be moved on the horizontal mandrel 7, are also fixed to the roller carrying plates 18, 18' by the screws 17. The slides 8 are displaced by upward or downward movement in the direction of the double arrow P of the guide 10 which is vertically displaceable on the columns 9 and 20.

By means of a ball and socket joint 21 and a connection rod 22, with the aid of a cam plate (which is not shown but should be thought of as being at the bottom right hand corner in FIG. 4), the connecting rod is moved upwards and downwards, so that the guide 10 and thus the mandrel 7 are also movable in the direction of the arrow P via the joint 21. This drive gives the cam rollers 12, 12' their vertical drive component, while the horizontal component is given positively by the cams 14, 14'.

In this way the extending fingers can move in a plane which should be thought of as being above the top seam strip 2. The plane can be seen e.g. in FIGS. 3 and 5. It is the plane extending through the fingers 1, 1'.

The welding station can conveniently be explained with reference to FIGS. 3 to 6. Two torsion shafts 27, 27' are held on the bracket 38 and adapted to turn in bearings, one of which is referred to as 36 and shown at the top right hand corner of FIG. 5. The torsion shafts are parallel with the plane of movement of the fingers 1, 1' and arranged at equal distances on each side thereof. The shaft 27, 27' is in a sleeve 28. The connection between the shaft 27, 27' and the sleeve 28, 28' can be seen from FIG. 3. It is in the form of a key 31. In other embodiments the connection may be provided by a multiple keyway or a polygonal fit. The key 31 is screwed fast in the shaft 27, 27'. The sleeve 28 (and the other side, marked with an apostrophe) has a suitably fitting slot into which the key 31 is inserted from outside, through the sleeve 28 into the shaft 27, and screwed therein. This connection prevents any rotation between the shaft 27 and the sleeve 28.

The sleeve 28 is further provided with a slot at 29. As a means of preventing play between the movement of the shaft 27 and that of the sleeve 28, which might be caused by the key 31 being deflected in operation by the permanent oscillating strain, a clamping means is provided, namely a clamp-type reinforcement 30 which is welded onto each half of the sleeve 28 over both sides of the slot 29. The two reinforcements 30 may be clamped towards one another by a screw 37. In this way the slot 29 in the sleeve 28 is pressed together.

The fact that the power transmission through the key 31 and also the slot clamping means 29, 30 is arranged exactly midway along the shaft 27 is also favourable, since it means that the two welding jaws 3, 3' are kept parallel when they are moved apart and brought together and during the welding operation.

The pivoted levers, 5, 5'; 25, 25' are fixed to the sleeve (FIG. 5). The welding jaws 3 are thus turned by means of the levers 5 via the sleeve 28, the clamped connection 29, 30, 37, the key 31 and the shaft 27. Two different positions of the levers 5 and jaws 3 can be seen in FIGS. 2 and 3, namely an intermediate position and the welding position.

The drive for moving the shafts is provided by a hydraulic cylinder 24, which is set in operation when the guide 10 moves downwards, through mechanical contact between the bottom end 10' of the guide 10 and a proximity switch 23. The proximity switch 23 (FIG. 4) is arranged relative to the bottom end 10' of the guide 10 so as to allow the movement illustrated diagrammatically in FIGS. 1 and 2 to take place.

By the action of the hydraulic cylinder 24, the piston 35' shown in FIG. 3 is moved downwards, with the aid of the joint 34, so that the point 39, corresponding to the axis line in FIG. 6, is moved from position C near the top of FIG. 3, down into position D. The high leverage along the bars 33 gives rise to extremely high compressive forces between the sealing jaws 3 and 3'. The compensating element for the high compressive forces is equalised by the torsion of the shaft 27 and sleeve 28, so that there is finally a parallel pressure between the surfaces of the two welding jaws 3, 3'. In this way lateral compensating bearings or constructions to bring about the parallel balancing of forces are advantageously avoided.

The forked construction of the joint 34 shown in FIG. 6 enables the levers 32, 32' fixed to the shaft 27, 27' to pivot. The connection between the lever 32 and shaft 27 can again be made by a feather, a multiple keyway or a polygonal fit. It will now be seen how the levers 32 and thus the welding jaws 3 are moved by the movement of the piston 35' when the hydraulic cylinder 24 comes into action.

The second half of the base portion 1" of a further extending station or of the extending fingers provided symmetrically to the left is indicated in broken lines at the left hand side of FIG. 5. FIG. 5 also shows the lateral displacement rails 40, responsible for pressing in the opened out pack shown in FIG. 4, when the pack is inserted from right to left for folding and sealing as shown in FIG. 5.

A different embodiment of the invention, relating to the cam member and the control means or drive for the extending fingers 1, 1', is shown and explained with reference to FIGS. 7 to 9.

Whereas in the first embodiment illustrated in FIGS. 1 to 6 the cam member is in the form of cams 14, 14' in the stationary plate 15, the cam 107 shown in FIGS. 7 to 9 must be symmetrical in construction, i.e. paired, since the two extending fingers 1, 1' (on one side of the double station) must again be able to move away from one another.

Standing vertically at the right hand side of FIG. 7 is the stationary column 112 (corresponding to the connecting rod 22 and bracket 38 in the first embodiment). The pivoted shaft carrier 110, extending horizontally, is mounted at the top of the column (and in turn corresponds substantially to the mandrel 7 and guide 10 in the first embodiment). The pivoting shaft 111 is shown at the left hand end of the shaft carrier 110 in FIG. 7; two pivoted levers 115, 115', each connected to a cam roller 12, 12', are rotatable about the shaft 111. In a preferred embodiment shown in FIG. 8 the pivoted levers 115 (at the right hand side of the double station) and 115" (at the left hand side of the double station) are shown in their special construction. In this form in FIG. 8 the knife-like extending fingers 1, 1" are shown inserted and screwed in. Whereas only the front or left hand finger of each pair (1, 1") can be seen in FIG. 8, both fingers 1 and 1' of a pair are visible in FIG. 7. At the engaging ends of the fingers, shown at the bottom in the figures, i.e. opposite and shortly before engagement in the upper folded seam strip 2 of the pack 35, each finger is in strip form with narrow edges. The corners E, E' of the external rounded corner of the finger, which moves into the critical portion S of the seam strip 2 (FIG. 1) from inside, can also be seen in FIG. 7. FIG. 7 also shows the movement curve of the corner E or E', corresponding to the path B1 in FIG. 1. This curve illustrates the movement of the fingers 1, 1' from the full line position shown in FIG. 7, the initial position, to the final position which is shown in broken lines in FIG. 7 and substantially corresponds to that in FIG. 1. Controlled by the cam 107, the pivoted lever 115 is first guided straight down, a certain distance vertically, by means of the cam roller 12, then slightly outwards to the point S on the upper seam strip 2, which is now engaged by the extending fingers and can be extended. This point S on the strip 2, like the corner E of the finger 1, runs along a given curve which is controlled by the curve 107 by means of the cam roller 12. In this embodiment shown in FIGS. 7 to 9 the horizontal direction of movement is obtained by the swinging of the lever 115 in the direction of the double arrow 116. It swings from the vertical position, i.e. the initial position at the top of the movement curve B1, first straight down, then in a curve to the location S, so that the finger comes into the broken line position in FIG. 7 and has been deflected substantially 25° from the axis of symmetry or the vertical. The swung-out position shown in broken lines in FIG. 7 is the final one, after which the sealing jaws 3, 3' are operated as described above and peel the upper seam strip 2 off the fingers 1, 1' which are then stationary.

As a means for fixing the cam 107 a girder 108 is shown, extending horizontally, substantially parallel with the shaft carrier 110. It substantially corresponds to the girder 13 in the first embodiment.

The forked construction of the shaft carrier 110 can be seen from FIG. 9. The carrier can be moved upwards and downwards as indicated by the vertical double arrow 117 in FIG. 7, by a drive similar to the members 21, 22 in FIG. 4 together with the pivoted levers 115. The horizontal pivoting movement of the cam rollers 12, 12' and thus of the levers 115, 115' is indicated by the double arrow 118 in FIG. 9. One roller-carrying shaft 105 is necessary for each cam roller 12, i.e. for each finger 1, and the shaft 105 may be long enough to connect one of the two fingers of each pair. In other words the roller-carrying shafts 105, 105' link the two pairs of fingers.

FIG. 10 finally shows a different way of fixing the sealing jaw 3' which is connected to the electrical resistance wire and therefore subjected to greater wear, to the shaft 27. The figure 10 construction is provided in order to facilitate the exchanging of the sealing jaw 3', without having to dismantle the double layer arrangement with the bars 33, the levers 32 and the joint 34 (FIG. 3). Instead of the lever 32 in FIG. 3 there are here two drive levers, namely the first drive lever 101 and the second drive lever 100, which is pivotable about the shaft 119. Although the first lever 101 pivots with it, this is the only lever that is connected to the shaft 27 by the feather 31 (only indicated diagrammatically here). The two levers 100 and 101 are interconnected with a resilient bias by a packet of plate springs 120 with a tie rod 121 and screws or nuts 102, so that the movement of one can be transmitted to the other with resilient compensation. The advantage of this construction, apart from the balancing of forces, is that it is easy to dismantle. If the nut 102 is released, the first drive lever 101 can then be swung out along the arc 103, so that the sealing jaw 3' (not shown) is swung out and readily accessible for exchange, while the second lever 100, the only one pivotable about the shaft 119, does not turn with the shaft 27 and instead remains in the position shown in FIG. 10.

I claim:

1. Apparatus for sealing the top of an open-ended paperboard container coated with plastic on at least one surface with a single elongated seam strip that extends across the middle of the top of the container, comprising a pair of flat and relatively thin fingers having rounded corners with said fingers extending along an axis, means for supporting a container in a position with its open end facing said fingers and the axis of the fingers extending in a plane perpendicular to the top edge of the open end of the container, means for moving the fingers in said plane perpendicular to the edge and into the top of the container a given distance, cam means for simultaneously moving the fingers apart as they are inserted into the container to stretch the edges of the open end of the container into an elongated opening consisting of two closely spaced edges extending across the middle of top of the container, a pair of welding jaws mounted on opposite sides of the fingers and the elongated opening for pivoting movement about an axis parallel to said elongated opening, and means for pivotally moving the jaws synchronously with the downward and outward movement of the fingers toward each other to engage the outer side of the two closely spaced edges of the elongated opening, to strip them off the fingers while the fingers are held stationary and hold the container in its stretched condition and to seal them together into a single elongated seam strip having two triangular flaps extending in one plane on either side of the container.

2. The apparatus of claim 1, wherein each welding jaw is mounted on and extends between one end of two levers, the other end of said levers being pivotally mounted about a common shaft located on opposite sides of and parallel to the elongated opening formed in the top of the container by the fingers.

3. The apparatus of claim 1, wherein said cam means comprises a cam plate having two cam surfaces, a cam roller rotatably mounted on each finger and movable along said cam surface, whereby movement of the fingers into the top of the container moves the rollers along the cam surfaces and simultaneously moves the fingers apart.

4. The apparatus of claim 3, including a mandrel mounted for up and down movement and extending in a plane parallel to the plane of the fingers, said fingers being slidably mounted on the mandrel, whereby downward movement of the mandrel moves the fingers into the top of the container and simultaneously moves the rollers along the cam surfaces to slide the fingers apart along said mandrel.

5. The apparatus of claim 4, wherein the cam surfaces are curved slots in the cam plate and the cam rollers are guided therein.

6. The apparatus of claim 4, in which each finger is L-shaped, with one side of the L being inserted into the top of the container and the other side being slidably mounted on the mandrel, the mandrel being mounted for movement in a plane parallel to and offset from the plane of the elongated opening.

7. The apparatus of claim 3, including a girder mounted for up and down movement and carrying a shaft extending perpendicular to the plane of the fingers, two levers pivotally mounted at one end on the shaft, one of each of said fingers being mounted to the opposite end of each lever with the cam roller mounted on the lever intermediate its ends, whereby downward movement of the girder moves the fingers down into the top of the container and simultaneously moves the rollers along the cam surfaces to move the fingers apart.

8. The apparatus of claim 7, wherein the deflection of the pivoted levers is less than 30°.

9. The apparatus of claim 2, wherein the shaft pivotally mounting the levers for each jaw is pivotally mounted to a first drive lever, which in turn is connected with a resilient bias to a second drive lever, which is pivotally connected to the drive means for operating the jaws.

10. The apparatus of claim 1, wherein the means for supporting the container during sealing comprises a base rail for supporting the bottom of the container, a pair of spaced side rails located intermediate its ends, and a pair of spaced guide plates located on either side of the container near the open top, said two triangular flaps formed on either side of the container during sealing laying against these guide plates after the welding jaws have stripped the top edges of the container off the fingers and sealed them together.

* * * * *